United States Patent [19]

Berkman

[11] 4,185,392

[45] Jan. 29, 1980

[54] LETTERING TEMPLATE

[75] Inventor: Samuel Berkman, Florham Park, N.J.

[73] Assignee: BST Associates, Florham Park, N.J.

[21] Appl. No.: 898,651

[22] Filed: Apr. 21, 1978

[51] Int. Cl.[2] ..... B43L 13/20

[52] U.S. Cl. ..... 33/174 B

[58] Field of Search ..... 33/174 B; 35/37; D19/37, 40

[56] References Cited

U.S. PATENT DOCUMENTS

| | | | |
|---|---|---|---|
| 147,942 | 2/1874 | Hutchinson | 33/174 B |
| 1,369,470 | 2/1921 | Rian | 33/174 B |
| 2,229,757 | 1/1941 | McEniry | 33/174 B |

FOREIGN PATENT DOCUMENTS

| | | | |
|---|---|---|---|
| 546200 | 3/1932 | Fed. Rep. of Germany | 33/174 B |
| 800542 | 11/1950 | Fed. Rep. of Germany | 33/174 B |

*Primary Examiner*—Richard R. Stearns

*Attorney, Agent, or Firm*—Stephan Siegel

[57] ABSTRACT

A drawing template for forming relatively large alphanumeric characters is comprised of a thin substrate in which a plurality of both linear and non-linear slots are formed. Lines drawn through selected ones of the slots form an outline of a desired character.

5 Claims, 5 Drawing Figures

FIG. 1
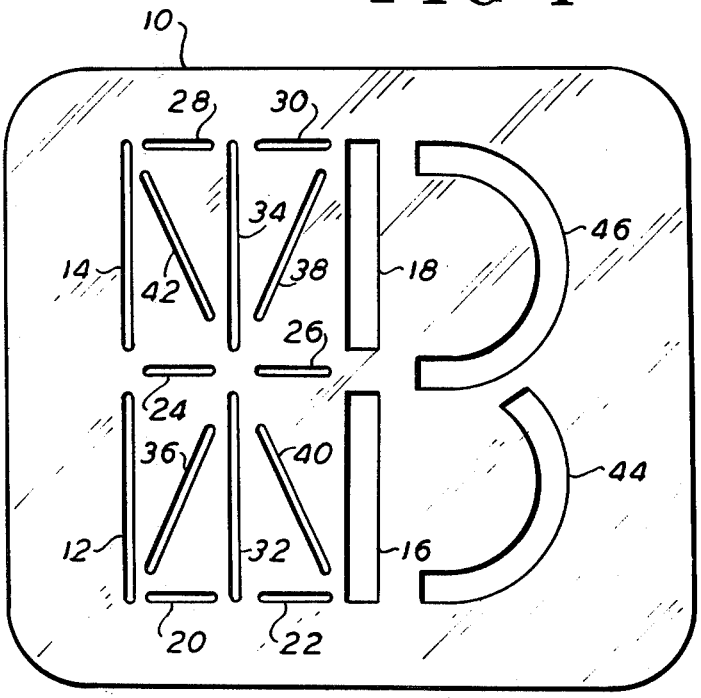
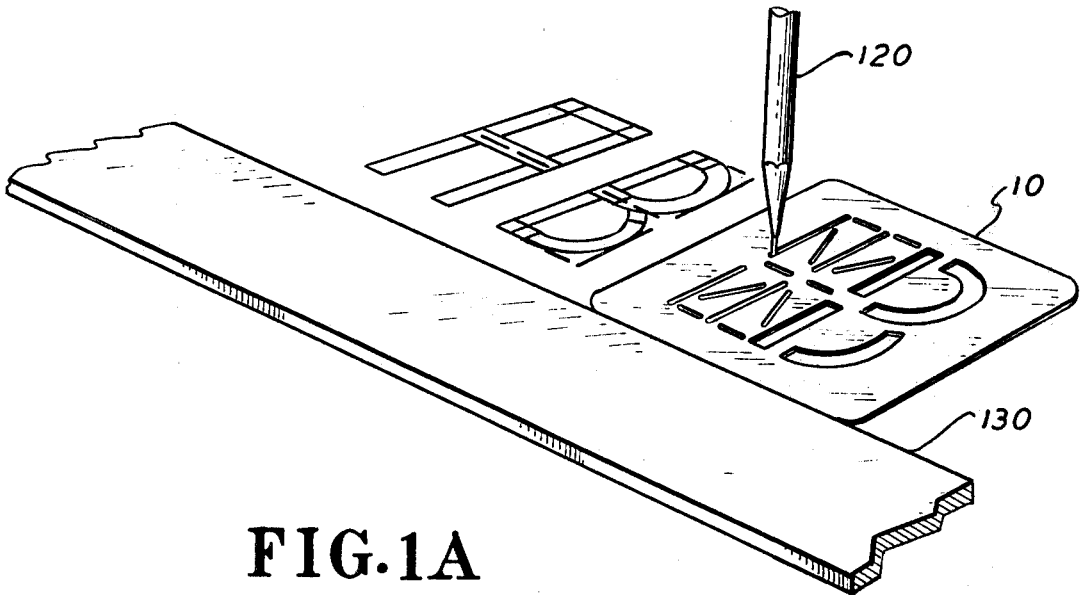
FIG. 1A

LETTERING TEMPLATE

This invention concerns templates and more particularly a lettering template of relatively small size suitable for drawing a wide variety of relatively large alphanumeric symbols.

Lettering templates for drawing a wide variety of alphanumeric symbols have in general been relatively large in size for those suitable for making characters of, for example, three inch height. The relatively large size of the prior art templates was caused by the necessity for having an individual template for each alphanumeric character. Illustratively, if a lettering guide were constructed having individual lettering templates for each of the alphanumeric symbols wherein such symbols were three or four inches high and two or three inches wide, such templates might conceivably be several feet in length and height. Further, those lettering templates which have been relatively small in size have failed to provide adequate means for indexing the characters to a specific height and width.

A template that is relatively small in size and suitable for drawing alphanumeric characters is comprised of a planar substrate substantially rectangular in shape having a plurality of non-touching slots therein. The plurality of slots is arranged with a first pair lineraly disposed along a first course. A second pair of slots is lineraly disposed along a second course parallel to the aforesaid first course. A third pair of slots is lineraly disposed along a third course having a first end adjacent to a first end of the first pair of slots and a second end adjacent a first end of the second pair of slots. A fourth pair of slots is arranged substantially parallel to the third pair of slots and has a first end disposed in close, non-touching relationship to adjacent ones of the first pair of slots and a second end disposed in close, non-touching relationship to adjacent ones of the second pair of slots. A fifth pair of slots substantially parallel to the third pair of slots has a first end disposed adjacent to a second end of the first pair of slots and a second end disposed adjacent a second end of the second pair of slots. A sixth pair of slots is lineraly disposed along a course having a first end adjacent the first end of the first pair of slots and a second end adjacent the second end of the second pair of slots. A seventh pair of slots is lineraly disposed along course having a first end adjacent the second end of the first pair of slots and a second end adjacent the first end of the second pair of slots. A first non-linear slot is arranged with a first end adjacent a second end of the second pair of slots and a second end, in close, non-touching relationship to adjacent ones of the second pair of slots. A second non-touching slot is arranged with a first end adjacent the first end of the second pair of slots and a second end adjacent the first non-linear slot.

A better understanding of the aforementioned invention may be derived with reference to the drawings of which:

FIG. 1 is a template suitable for drawing relatively large size figures in accordance with the present invention;

FIG. 1A illustrates in part the operation of the template in FIG. 1;

Figure 2:
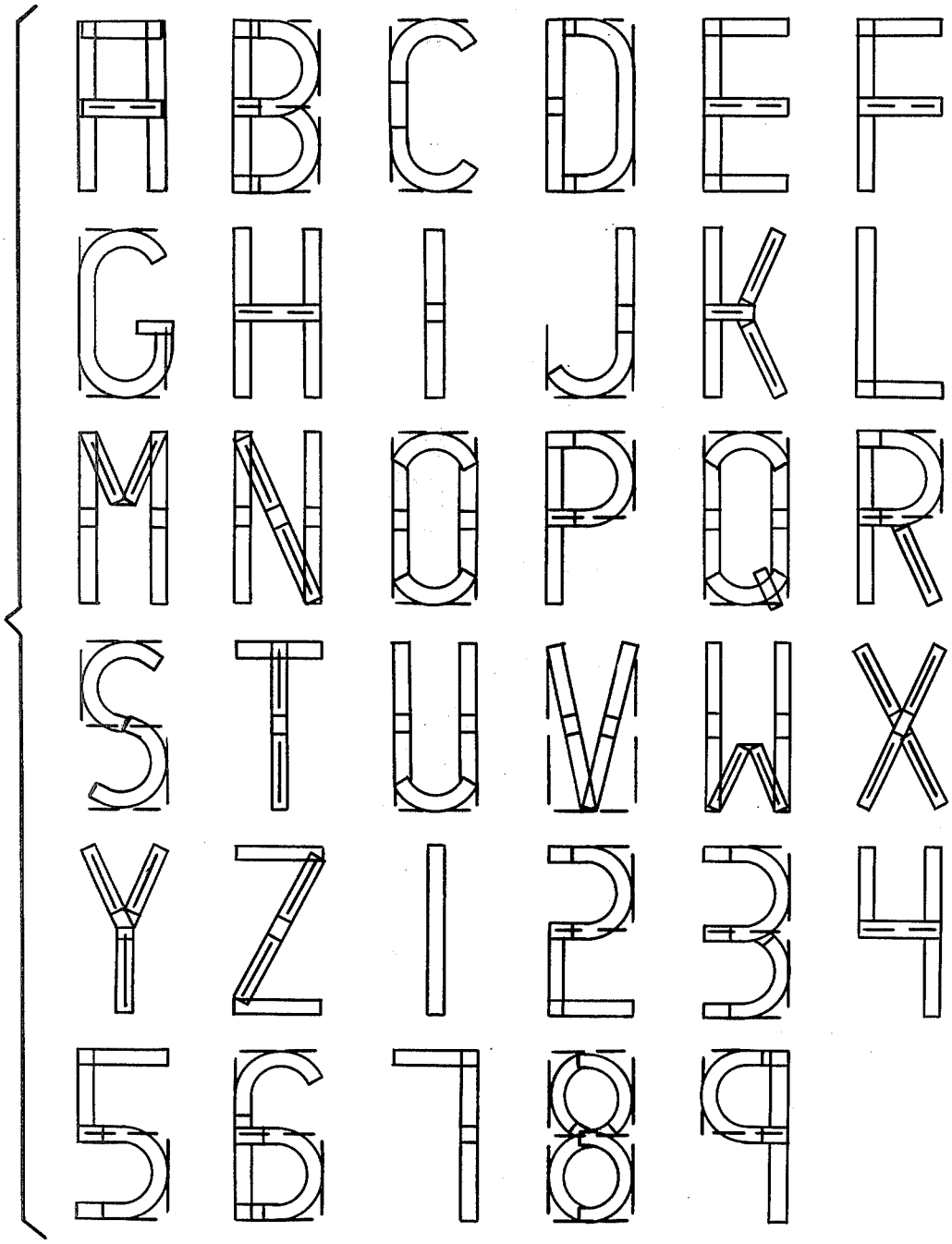
FIG. 2 is a series of alphanumeric characters drawn with the aid of the templates illustrated in FIG. 1.

With reference to FIG. 1, a relatively thin material substrate 10 is illustratively formed of 1/32 inch thick clear plastic. Material 10 has a large plurality of slots therein each of which has a relatively narrow width in comparison to length. A first lineraly disposed pair of slots formed in material 10 is comprised of slots 12 and 14. A second lineraly disposed pair of slots parallel to the aforementioned pair is comprised of slots 16 and 18. Slots 16 and 18 are preferably formed to a relatively large width substantially equal to the desired width of the alphanumeric character segments. These slots are respectively formed with length substantially equal to the spacing between the first and second linearly disposed pairs of slots (12, 14 and 16,18). Use of these relatively wide slots will become apparent later with reference to the example that follows. Interposed between these parallel pairs of slots (12, 14 and 16, 18) and in substantially perpendicular relationship thereto are three pairs of lineraly disposed slots respectively comprised of slots 20 and 22, 24 and 26, and 28 and 30. A sixth lineraly disposed pair of slots, 32 and 34 is arranged in parallel relationship with the first and second pair of slots and interposed therebetween. A seventh lineraly disposed pair of slots, 36 and 38 is diagonally interposed between the first parallel pair of slots (12, 14) and the second parallel pair of slots (16, 18). An eighth lineraly disposed pair of slots, 40, 42 is diagonally interposed between the first and second parallel pairs of slots (12, 14 and 16, 18) in anti-parallel relationship with the seventh pair of slots 36, 38. A first non-linear slot 46 has a first end adjacent slot 18 and is formed to a substantially semi-circular shape with diameter of approximately one-half the total height of alphanumeric characters drawn with the subject apparatus. A second end of slot 46 has its center in line with slots 26 and 24. A second non-linear slot 44 has an end adjacent slot 16 and is formed to a circular arc of less than 180 degrees. Arc 44 has a radius of curvature similar to that of arc 46 but is of shorter circumferential length.

Figure 3:
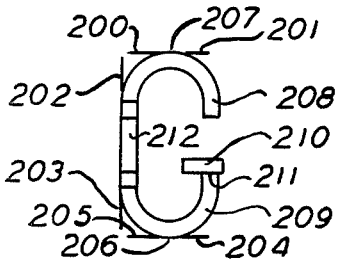
FIG. 3 illustrates an outline of the letter "G" as drawn with the present invention.
Figure 3A:
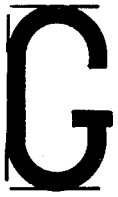
FIG. 3A illustrates the letter in FIG. 3 after being traced over with a felt tip marking pen.

In the operation of the above described template, a straight edge 130 (see FIG. 1A) is placed in a position parallel with the line on which characters are to be drawn. A pencil (120) or similar drawing device is inserted into ones of the slots of template 10 and utilized to sketch the outline of the figure desired to be drawn. Illustratively, the letter "G" may be sketched by inserting a pencil in slots 12, 14, 20 22, 28 and 30 to form an open rectangle 200, 201, 202, 203, 204, 205 defining three of the boundries of this letter (see FIG. 3). The open rectangle thereby formed, operates as indexing means to define the boundries on three sides of the letter to be formed. Semi-circular slot 46 is thereafter rotated to have an edge in touching relationship with the line 203 and the median point of its arc 206 centrally located between the lines 204 and 205. Slot 46 is then traced with the pencil to form arc 209. Template 10 is once again rotated to place an edge of slot 46 in touching tangential relationship with the line 202, and the median point of its arc 206 centrally located between the lines 200 and 201. After tracing slot 46 to form arc 208, template 10 is repositioned to align slot 18 along lines 202 and 203 for connecting the two semi-circular arcs 208 and 209 with rectangle 212. Slot 18 is lastly employed to draw a horizontal slot 210 of desired length adjacent to the end 211 of the semi-circular arc 209. To complete the letter, the outline in FIG. 3 is traced over with, for example, a felt tip marking pen to form the letter illustrated in FIG. 3A.

The apparatus in FIG. 1 may be utilized for drawing outlines as shown in all the alphanumeric characters of FIG. 2 with the exception of the letter "V". The letter "V" in this instance is sketched by placing a dot at the lower extreme of slot 32 and at the upper extremes of slots 14 and 18. The dot drawn in slot 14 is then connected to the dot drawn in slot 32 and similarly, the dot drawn in slot 18 is connected to the dot drawn in slot 32. Slot pair 16, 18 may be utilized for making this dot connection.

While the apparatus of FIG. 1 is illustrated for drawing characters having a relatively rectangular shape, other configurations suitable for drawing letters at a slight incline may be made without adverse effect to the present invention. Similarly, with the use of the subject apparatus certain characters may be drawn in a slightly different configuration than illustrated in FIG. 2. Illustratively, the letter "A" may be drawn by utilizing an inverted "V" to form the sides of this figure. Other modification of characters will become apparent to those skilled in the art.

What is claimed is:

1. An alphanumeric lettering guide comprising:

A planar substrate having a plurality of slots therein, said plurality arranged with a first pair of slots linearly disposed along a first course, a second pair of slots linearly disposed along a second course parallel to said first course, a third pair of linearly disposed slots disposed along a third course having a first end adjacent a first end of said first pair of slots and a second end adjacent a first end of said second pair of slots, a fourth pair of linearly disposed slots substantially parallel to said third pair of slots having a first end disposed in close, non-touching relationship to adjacent ends of ones of said first pair of slots and a second end disposed in close, non-touching relationship to adjacent ends of ones of said second pair of slots, a fifth pair of linearly disposed slots substantially parallel to said third pair of slots having a first end disposed adjacent to a second end of said first pair of slots and a second end disposed adjacent a second end of said second pair of slots, a sixth pair of slots linearly disposed along a course having a first end adjacent a first end of said first pair of slots and a second end adjacent a second end of said second pair of slots, a seventh pair of slots linearly disposed along a course having a first end adjacent a second end of said first pair of slots and a second end adjacent a first end of said second pair of slots, a first non-linear slot having a first end adjacent a second end of said second pair of slots and a second end aligned with said fourth pair of slots in close non-touching relationship to adjacent ones of said second pair of slots, a second non-linear slot having a first end adjacent said first end of said second pair of slots and a second end adjacent said first non-linear slot, said first and second non-linear slots and said second pair of linearly disposed slots having width substantially greater than the width of others of said slots.

2. Apparatus according to claim 1 wherein:

said slots have length substantially greater than width.

3. Apparatus according to claim 1 wherein:

said lettering guide includes a non-touching plurality of slots at least one of which is non-linear in shape having a substantially circular perimetral boundary.

4. Apparatus according to claim 3 wherein:

said lettering guide includes a first and second non-linear slot each having an arc with substantially equal radius.

5. Apparatus according to claim 3 including:

an eighth pair of slots lineraly disposed along a course passing between said first and second pairs of slots and parallel thereto.

* * * * *